United States Patent [19]

van der Heijden et al.

[11] Patent Number: 4,527,097

[45] Date of Patent: Jul. 2, 1985

[54] HIGH-PRESSURE SODIUM DISCHARGE LAMP

[75] Inventors: Rudolf L. A. van der Heijden, Eindhoven; Jan W. F. Dorleijn, Roosendaal, both of Netherlands

[73] Assignee: U.S. Philips Corporation, New York, N.Y.

[21] Appl. No.: 490,802

[22] Filed: May 2, 1983

[30] Foreign Application Priority Data

May 10, 1982 [NL] Netherlands ..... 8201900

[51] Int. Cl.[3] ..... H01J 61/22; H01J 61/30; H01J 61/073; H01J 41/24

[52] U.S. Cl. ..... 315/246; 313/631; 313/634; 313/638

[58] Field of Search ..... 313/634, 631, 638, 639, 313/642; 315/246

[56] References Cited

U.S. PATENT DOCUMENTS 4,052,636 10/1977 Strok ..... 313/631

4,109,175 8/1978 Watarai et al. ..... 313/634 X

*Primary Examiner*—Palmer Demeo

*Attorney, Agent, or Firm*—Robert S. Smith

[57] ABSTRACT

The invention relates to a high-pressure sodium lamp provided with an elongate discharge vessel in which the pressure P in the operative condition of the lamp is at least $170\times10^3$ Pa. The lamp is suitable to be operated with a power of periodically alternating value, which power comprises at least one component having a frequency $\nu_i$ which satisfies $i-0.45\leqq2.35\nu_i Le/e\leqq i+0.45$ where i is an integral positive number, c is the speed of sound in the gaseous part of the filling and $L_e$ is the effective length of the discharge vessel. According to the invention, the relation is satisfied: $M\nu_i \cdot f_i \cdot P \cdot d \leqq 185$, in which $M\nu_i$ is the modulation depth of the power component having a frequency $\nu_i$, $f_i$ is a geometric lamp factor and d the average inner diameter of the discharge vessel. In this manner, the operation of the lamp is free of arc instabilities due to longitudinal acoustic resonances.

10 Claims, 5 Drawing Figures

HIGH-PRESSURE SODIUM DISCHARGE LAMP

BACKGROUND OF THE INVENTION

The invention relates to a high-pressure sodium discharge lamp provided with an elongate discharge vessel which encloses a discharge path and which vessel has an effective length $L_e$ and, over at least $\frac{2}{3}$ of the discharge path, a cross-section S of constant area, in which vessel two electrodes are arranged each having an end between which ends the discharge path extends, this lamp being suitable to be operated in operative condition with a power of periodically alternating value, this power comprising one or more power components sinusoidally varying with time and at least one component having a frequency $\nu_i$ for which it holds that $-0.45 \leqq 2.35\nu_i \text{ Le/c} \leqq 0.45+i$ where i is an integral positive number and c the average speed in m/s of propagation of sound waves through the gaseous part of the filling of the discharge vessel in the operative condition of the lamp. The invention further relates to an arrangement suitable to operate such a high-pressure sodium discharge lamp.

Discharge lamps are frequently operated with an alternating voltage source, for example, at the usual mains frequency. It is also known to operate lamps at higher frequencies. In case of such an alternating voltage operation, the lamp consumes a power of periodically alternating value. As is known, each power of periodically alternating value can be represented by means of Fourier transformation as a series of power components of mutually different frequencies sinusoidally varying with time, which series may also comprise a power component of constant value.

An elongate discharge vessel is to be understood in this description and in the appended claims to mean a vessel, the efffective length $L_e$ of which and the largest inner diameter D of the part of the discharge vessel having a cross-section S of constant area satisfy the relation $\text{Le/D} \geqq 2$. For a circular cross-section S, the largest inner diameter D will correspond to the inner diameter d of the circular cross-section. The effective length Le of the discharge vessel is the quotient of the volume enclosed by the discharge vessel and the surface area of the cross-section S of constant area. The effective length Le is to be considered as being composed of that part of the length between the ends of the electrodes over which the discharge vessel has a cross-seciton S of constant area plus the length of remaining end volumes of the discharge vessel standardized with respect to this cross-section. The expression end volume is to be understood herein to mean the volume enclosed by the discharge vessel near an electrode minus the volume occupied by the electrode.

The average speed c of propagation of sound waves through the gaseous part of the filling of the discharge vessel is determined by the relation $(c_p/c_v)^{\frac{1}{2}} \cdot (R\overline{T}/\overline{M})^{178}$, in which: $c_p/c_v$ is the ratio of specific heat at constant pressure and specific heat at constant volume of the gaseous part of the filling of the discharge vessel, R is the universal gas constant (8.313 J $mol^{-1} K^{-1}$) $\overline{T}$ is the mean temperature of the gaseous part of the filling of the discharge vessel in K, and $\overline{M}$ is the mean weight per mole of the gaseous part of the filling of the discharge vessel, expressed in kg/mol.

In high-pressure sodium vapour discharge lamps, the said speed of sound is approximately 500 m/s and the mean temperature $\overline{T}$ is approximately 2500 K. The mean weight $\overline{M}$ per mole of the gaseous part of the filling then is of the order of 0.15 kg/mol.

The expression "operative condition of the lamp" is to be understood to mean herein the situation in which the stable discharge is maintained between the electrodes, while the expression "in-operative condition of the lamp" is to be understood to mean the situation in which no discharge takes place between the electrodes.

when a lamp is operated with a power of alternating value, pressure variations will occur correspondingly in the gaseous part of the filling of the discharge vessel. In certain circumstances, this may lead to the occurrence of standing pressure waves. This phenomenon is known as "acoustic resonances". Due to the acoustic resonances, the discharge may be forced out of its position. Arc instabilities are then obtained. When the discharge is forced out of its position, this results in variations of lamp properties and may even result in that the lamp extinguishes.

A lamp of the kind mentioned in the preamble is known from the U.S. Pat. No. 4,052,636. It is suggested in this known patent specification to prevent the occurrence of arc instabilities due to longitudinal acoustic resonances when the known lamp is operated with a power of periodically alternating value by choosing the distane between the electrode ends to be smaller than 0.8 times the length of the discharge vessel. The lamp is then operated at unidirectional voltage pulses at a repetition frequency of 1 kHz and 667 Hz and with a pulse duration of 20%. Experiments have shown that the measure as described in the said U.S. patent specification has only a limited use. With the power forms described in the said patent specification, the means suggested prevent the occurrence of arc instabilities due to longitudinal acoustic resonances, it is true, but it has been found that, when such a high-pressure discharge lamp is operated with other power forms, arc instabilities due to longitudinal acoustic resonances will still occur. The filling in the discharge vessel of the known lamps has a comparatively low pressure. It may in fact be deduced that the pressure of the filling in the discharge vessel of the known lamp in the operative condition is not higher than $155 \times 10^3$ Pa, the pressure of the sodium being not higher than $20 \times 10^3$ Pa.

High-pressure sodium vapour discharge lamps are generally used in public illumination, such as street illumination, because they have a high luminous efficacy. If no particular measures are taken, however, these lamps are not particularly suitable for interior illumination, for example in sports halls, and are certainly not suitable to be used in the domestic field because their color rendition is less satisfactory. A light source suitable for interior illumination namely requires that the general color rendition index Ra of the emitted radiation is at least 60.

It is known that the general color rendition index Ra reaches a value desired for interior illumination purposes if the pressure of the sodium in the operative condition of the lamp is higher than in the case of the known lamp, i.e. at least $30 \times 10^3$ Pa, the pressure of the filling in the discharge vessel then being correspondingly higher.

It has been found that the occurrence of arc instabilities due to acoustic resonance in the discharge vessel is strongly dependent upon the pressure of the filling, a higher pressure leading more readily to the occurrence of arc instabilities.

The invention has for its object to provide a measure by means of which the occurrence of arc instabilities due to longitudinal acoustic resonances is prevented even at higher pressures of the filling.

SUMMARY OF THE INVENTION

According to the invention, a lamp of the kind mentioned in the preamble is characterized in that the filling in the operative condition has a pressure P in Pa of at $170\times10^3$ Pa and in that for each i the relation $M\nu_i \cdot f_i \cdot P \cdot d \leqq 185$ is satisfied, in which $M\nu_i$ is the modulation depth of the power component having frequency $\nu_i$, $f_i$ is geometric lamp factor and d is the mean inner diameter of the cross-section S in meters. The modulation depth $M\nu_i$ of the power component with the frequency $\nu_i$ is the ratio of the amplitude of this power component and the time average of the total operating power of the lamp in the operative condition. This ratio is larger than 0. The geometric lamp factor $f_i$ depends upon the effective length Le and upon an insertion depth $PB_1$ and $PB_2$ assigned to each of the electrodes according to the relation:

$$f_i = |\{\sin(i\pi PB_1/Le) + (-1)^i \sin(i\pi PB_2/Le)\}|/i$$

In this description and the appended claims, the insertion depth PB is defined as the distance between the electrode ends and the end surface having the area of the cross-section S of the adjacent standardized end volume. The insertion depth PB has a positive value if, viewed from the discharge path, the electrode end is located in front of the end surface, whereas it has a negative value if the electrode end is located behind the end surface. The value of $f_i$ will always satisfy the relation $0 \geqq f_i \geqq 2$. For practical lamps, $f_i$ will be at most 1 (for $Le > (PB_1 + PB_2)$).

The average inner diameter d is the diameter of a circle having the same surface area as that of the cross-section S.

A lamp according to the invention has the advantage that no disturbing arc instabilities due to longitudinal acoustic resonances of the gaseous part of the lamp filling occur. It should be noted that in the operative condition of the lamp, the longitudinal axis of the discharge vessel is allowed to make an angle with the vertical of at most 45°.

The invention is based on the recognition of the fact that the occurrence of longitudinal acoustic resonances depends not only upon the pressure P of the filling but also upon the modulation depth $M\nu_i$ of the power components, upon the mean inner diameter d and upon the shape of the discharge vessel. This dependence is such that an increase of these parameters $M\nu_i$, $f_i$, P and d leads to an increased possibility of the occurrence of arc instabilities due to longitudinal acoustic resonances. Experiments have shown that, if the product of the said parameters is not larger than 185, arc instabilities due to acoustic resonances do not occur.

It should be noted that for an elongate discharge vessel having an effective length Le and a largest inner diameter D for frequencies $\nu_i$ for which holds: $i-0.45 \leqq 2.35\nu_i Le/c \leqq i+0.45$ with $i \leqq 0.3$ Le/D, solely longitudinal acoustic resonances may occur. (See also: H.L. Witting "Acoustic resonances in cylindrical high-pressure arc discharges", Journal Appl. Physics, 49, May 1978, p. 2680–2683).

It is possible that the discharge vessel at the area of the first electrode has a form which is different from the form at the area of the second electrode. In an embodiment of a lamp according to the invention, in which the discharge vessel is substantially symmetrical with respect to a plane at right angles to the longitudinal axis of the discharge vessel, each electrode is associated with the same insertion depth PB and in the operative condition of the lamp for each even value of i the relation is satisfied:

$$(2M\nu_i/i)|\sin i\pi PB/LE|Pd \leqq 185.$$

An advantage of the lamp according to this embodiment is that the manufacture of a symmetrical discharge vessel is simpler than that of a non-symmetrical discharge vessel. Moreover, this embodiment of the lamp has the advantage that only those power component of which the value of the associated i is an even number play a part, because components having an odd value i are associated with a geometric lamp factor having a value 0.

In an embodiment of a lamp according to the invention, the relation is satisfied: $M\nu_i \cdot f_i \cdot d \leqq 140$. This embodiment has the advantage that owing to a limitation in the adjusting range of the parameters important for the arc instabilities due to acoustic resonance, the operating position of the lamp is entirely free.

In an embodiment of a lamp according to the invention, it advantageously holds that the operating power of the lamp is composed of one or more current and voltage components sinusoidally varying with time and all having frequencies of at least 20 kHz. Consequently, both the current and the voltage components as well as the power components with which the lamp is operated each have frequencies of more than 20 kHz and hence frequencies lying outside the range of human hearing.

In a particular embodiment of a lamp according to the invention, the consumed power of which is at most 100 W, the discharge vessel contains besides sodium and mercury in excess also a rare gas and the overall gas pressure in the operative condition of the lamp is at least $300\times10^3$ Pa and at most $1600\times10^3$ Pa.

Lamps according to this particular embodiment are particularly suitable for use in interior illumination because they can be manufactured in very compact form and can have a satisfactory color rendition.

The invention further provides an arrangement for operating a high-pressure sodium discharge lamp according to the invention. This arrangement is characterized in that it is provided with means for supplying to the lamp a power of periodically alternating value, which comprises one or more power components sinusoidally varying with time, at least one component having a frequency $\nu_i$ for which holds that $i-0.45 \leqq 2.35\nu_i Le/c \leqq i+0.45$, in which i is a positive integral number and c is the average speed in m/s of propagation of sound waves through the gaseous part of the filling of the discharge vessel in the operative condition of the lamp. Such an arrangement makes it possible to operate lamps according to the invention at suitable frequencies, especially also at high frequencies. The said means preferably comprise a semiconductor-converter circuit.

BRIEF DESCRIPTION OF THE DRAWING

Embodiments of lamps according to the invention will be described more fully with reference to a drawing, in which.

DESCRIPTION OF THE PREFERRED EMBODIMENTS

Figure 1:
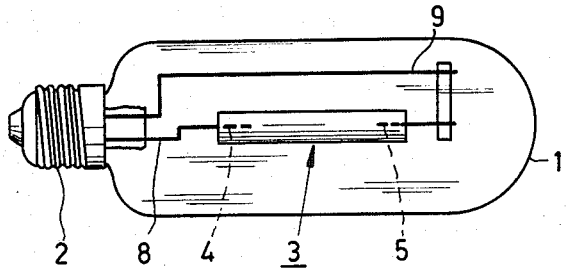
FIG. 1 shows a high-pressure discharge lamp.

The lamp shown in FIG. 1 has an outer bulb 1 provided with a lamp base 2. The outer bulb 1 encloses an elongate discharge vessel 3 in which two electrodes 4 and 5 are arranged. The electrode 4 is connected through a current-supply conductor 8 to a first connection contact of the lamp base 2. The electrode 5 is connected through a current-supply conductor 9 to a second connection contact of the lamp base 2. The connection contacts of the lamp base 2 are connected to an arrangement (not shown) for operating the lamp, which arrangement is provided with means for supplying to the lamp a power of periodically alternating value. The discharge vessel 3 is shown in longitudinal cross-section in FIG. 2. The discharge vessel 3 is symmetricalwith respect to a plane 12 perpendicular to the longitudinal axis of the discharge vessel 3. The electrodes 4 and 5 are respectively composed of an electrode rod 40 and 50 provided with an electrode winding 41 and 51. The discharge path extends between the ends 42, 52 of the electrodes 4, 5. The electrode 4 is connected to a lead-through member 80 which is electrically connected to the current-supply member 8. The lead-through member 80 is secured in a closing element 43 of the discharge vessel by means of a hermetic seal. In an analogous manner, the electrode 5 is connected to the lead-through member 90.

The discharge vessel 3 has a ceramic wall 3*a* of sintered alumina. Other possible wall materials are sapphire and yttrium oxide. The discharge vessel 3 has throughout its length a circular cross-section S of constant area with an inner diameter d of $6.85 \times 10^{-3}$ m. The volume enclosed by the discharge vessel is approximately $3 \times 10^{-6}$ m$^3$ and threrfore the effective length Le is $8.17 \times 10^{-2}$ m. The ratio of the effective length Le to the inner diameter d of the cross-section S is approximately 12, so that the requirement for an elongate discharge vessel is satisfied in that the said ratio is at least 2. The insertion depth PB associated with each of the electrodes 4 and 5 is $7.6 \times 10^{-3}$ m. The determination thereof is equal for both electrodes because the discharge vessel is symmetrical with respect to the plane 12, which will be described below for the electrode 4. A residual end volume of the discharge vessel 3 near the electrode 4 is limited by a plane 10 perpendicular to the longitudinal axis of the discharge vessel 3 and through the electrode end 42. The size of this end volume is the difference between the volume part 10*a* enclosed by the discharge vessel 3 and the volume occupied by the electrode 4 and amounts to $2.8 \times 10^{-7}$ m$^3$. When this residual end volume is standardized with respect to the circular cross-section S with an inner diameter d of $6.85 \times 10^{-3}$ m of the discharge vessel, the length and hence the insertion depth PB amounts to $7.6 \times 10^{-3}$ m.

The discharge vessel of the lamp concerned has a filling containing 20 mg of amalgram, which consists of 18.4% by weight of Na and 81.6% by weight of Hg. Moreover, the discharge vessel comprises xenon, which at 300 K has a pressure of $6.35 \times 10^3$ Pa.

Figure 5:
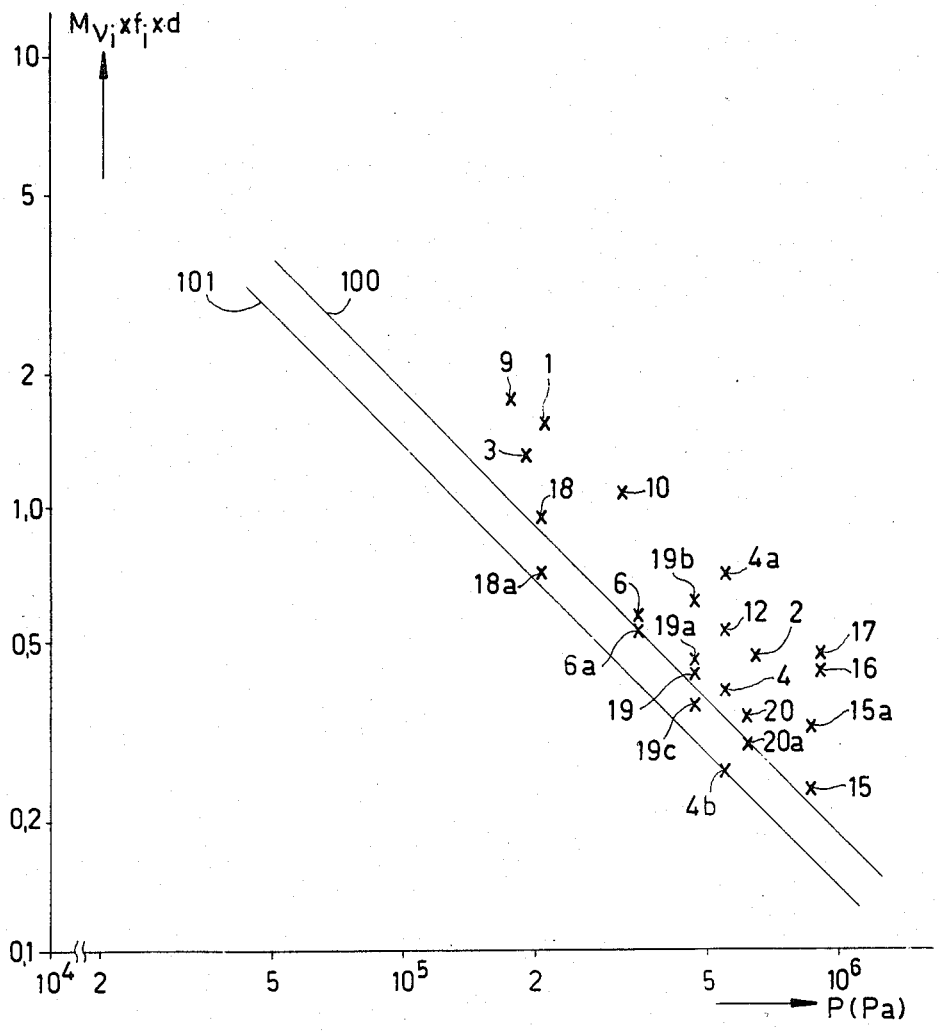
FIG. 5 shows a graph of relations $M\nu_i \times f_i \times d$ as a function of the pressure P.

The lamp concerned was operated in vertical position with an average power of 250 W. In the operative condition of the lamp, the average temperature in the discharge vessel was 2800 K and therefore the average speed of propagation c of sound waves through the filling was 482 m/s. The pressure P in the discharge vessel during operation was $209 \times 10^3$ Pa. The operating power of the lamp was composed of a component of constant value and of a component sinusoidally varying with time, the frequency $\nu_i$ of which was $5.92 \times 10^3$ Hz. The modulation depth $M\nu_i$ was then 0.25. In the lamp thus operated, just no arc instabilities due to longitudinal acoustic resonances occurred. For the lamp thus operated, the fraction $2.35\nu_i Le/c$ was equal to 2.33, which resulted in an associated positive integral number i with a value 2 and in a geometric lamp factor $f_i$ with a value 0.55. Thus, the product $M\nu_i \cdot f_i \cdot P \cdot d$ had the value 196, which is larger than 185. In the graph of FIG. 5, this corresponds to the point denoted by the reference numeral 18. In practice, the lamp just described would be operated so that the product $M\nu_i \cdot f_i \cdot P \cdot d$ has a value of at most 185 in order to certainly avoid the possibility of the occurrence of arc instabilities due to acoustic resonances.

The same lamp was operated in horizontal operating position at the same frequency $\nu_i$ of $5.92 \times 10^3$ Hz. The modulation depth $M\nu_i$, at which just no arc instabilities due to longitudinal acoustic resonances occurred, was in this case 0.19, so that the product $M\nu_i \cdot f_i \cdot P \cdot d$ had the value 149. In the graph of FIG. 5, the corresponding point is denoted by the reference numeral 18*a*. It is apparent from these measurements that in horizontal operating position a more stringent requirement is imposed on the value of the product $M\nu_i \cdot f_i \cdot P \cdot d$. In practice, this lamp will be operated in horizontal operating position so that the product $M\nu_i \cdot f_i \cdot P \cdot d$ is smaller than 140.

Figure 2:
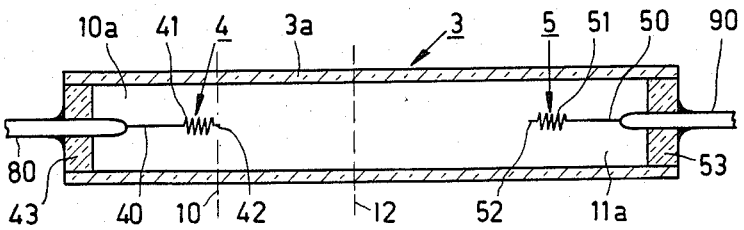
FIG. 2 shows diagrammatically a sectional view of the discharge vessel of the lamp according to FIG. 1, FIGS. 3 and 4 are sectional views of modifications of discharge vessels.

Furthermore, for a large number of lamps constructed according to FIG. 2 having different dimensions and operating pressures and with different powers, the value of the modulation depth $M\nu_i$ is determined, at which just no arc instabilities due to longitudinal acoustic resonances occur. The lamp data and measuring results are stated in the following table. Again these lamps would be operated in practice so that, dependent upon the operating position, the safe limit of 185 and 140, respectively, is not exceeded.

TABLE

| lamp number | HF68 | HF43 | HF29 | HF66 | HF84 | HF94 |
|---|---|---|---|---|---|---|
| mean inner diameter d discharge vessel (m) | $6.85 \times 10^{-3}$ | $3.3 \times 10^{-3}$ | $3.3 \times 10^{-3}$ | $3.3 \times 10^{-3}$ | $3.3 \times 10^{-3}$ | $3.3 \times 10^{-3}$ |
| insertion depth PB (m) | $6.68 \times 10^{-3}$ | $4.56 \times 10^{-3}$ | $4.56 \times 10^{-3}$ | $1.18 \times 10^{-2}$ | $6 \times 10^{-3}$ | $6 \times 10^{-3}$ |
| volume discharge vessel (m$^3$) | $8.99 \times 10^{-7}$ | $3.09 \times 10^{-7}$ | $3.09 \times 10^{-7}$ | $4.16 \times 10^{-7}$ | $4.01 \times 10^{-7}$ | $4.01 \times 10^{-7}$ |
| effective length Le (m) | $2.44 \times 10^{-2}$ | $3.68 \times 10^{-2}$ | $3.68 \times 10^{-2}$ | $4.87 \times 10^{-2}$ | $4.69 \times 10^{-2}$ | $4.69 \times 10^{-2}$ |
| Xe-pressure at 300 K (Pa) | $40.0 \times 10^3$ | $3.33 \times 10^3$ | $5.33 \times 10^3$ | $3.33 \times 10^3$ | $3.33 \times 10^3$ | $53.3 \times 10^3$ |
| mean weight per mole $\overline{M}$ of gaseous part of filling in operative | 0.138 | 0.171 | 0.143 | 0.171 | 0.171 | 0.145 |

TABLE-continued

| | | | | | | |
|---|---|---|---|---|---|---|
| condition (kg/mole) | | | | | | |
| mass amalgam-filling ($10^{-6}$ kg) | 10 | 10 | 10 | 10 | 10 | 10 |
| % by weight of Na/% by weight of Hg | 18.4/81.6 | 18.4/81.6 | 18.4/81.6 | 18.4/81.6 | 18.4/81.6 | 18.4/81.6 |
| average temperature $\overline{T}$ of gaseous part of the filling in operative condition (K) | 2000 | 2500 | 2500 | 2000 | 2450 | 2450 |
| propagation speed c (m/s) of sound waves | 448 | 450 | 492 | 402 | 446 | 481 |
| pressure P of the filling in operative condition (Pa) | $320 \times 10^3$ | $211 \times 10^3$ | $656 \times 10^3$ | $178 \times 10^3$ | $193 \times 10^{+3}$ | $544 \times 10^{+3}$ |
| operating position | vertical | vertical | vertical | vertical | vertical | vertical |
| average power (W) | 30 | 50 | 50 | 51 | 70 | 70 |
| frequency $\nu_i$ (Hz) | $1.48 \times 10^4$ | $1.13 \times 10^4$ | $1.26 \times 10^4$ | $6.6 \times 10^3$ | $8.3 \times 10^{+3}$ | $9.4 \times 10^{+3}$ |
| modulation depth $M_{\nu i}$ | 0.16 | 0.662 | 0.198 | 0.53 | 0.55 | 0.165 |
| $2{,}35 \frac{\nu_i Le}{c}$ | 1.89 | 2.17 | 2.2 | 1.88 | 2.05 | 2.15 |
| geometric lamp factor $f_i$ | 0.99 | 0.71 | 0.71 | 1 | 0.72 | 0.72 |
| $M_{\nu i} \cdot f_i \cdot P \cdot d$ | 347 | 327 | 304 | 311 | 252 | 213 |
| reference numeral in FIG. 5 | 10 | 1 | 2 | 9 | 3 | 4 |

| lamp number | HF94 | HF94 | HF94 | HF39 | HF39 | HF100 |
|---|---|---|---|---|---|---|
| mean inner diameter d discharge vessel (m) | $3.3 \times 10^{-3}$ | $3.3 \times 10^{-3}$ | $3.3 \times 10^{-3}$ | $4.8 \times 10^{-3}$ | $4.8 \times 10^{-3}$ | $6.85 \times 10^{-3}$ |
| insertion depth PB (m) | $6 \times 10^{-3}$ | $6 \times 10^{-3}$ | $6 \times 10^{-3}$ | $6.02 \times 10^{-3}$ | $6.02 \times 10^{-3}$ | $7.61 \times 10^{-3}$ |
| volume discharge vessel ($m^3$) | $4.01 \times 10^{-7}$ | $4.01 \times 10^{-7}$ | $4.01 \times 10^{-7}$ | $1.27 \times 10^{-6}$ | $1.27 \times 10^{-6}$ | $3.01 \times 10^{-6}$ |
| effective length Le (m) | $4.69 \times 10^{-2}$ | $4.69 \times 10^{-2}$ | $4.69 \times 10^{-2}$ | $7 \times 10^{-2}$ | $7 \times 10^{-2}$ | $8.17 \times 10^{-2}$ |
| Xe-pressure at 300 K (Pa) | $53.3 \times 10^3$ | $53.3 \times 10^3$ | $53.3 \times 10^3$ | $26.7 \times 10^3$ | $26.7 \times 10^3$ | $31.7 \times 10^3$ |
| mean weight per mole $\overline{M}$ of gaseous part of filling in operative condition (kg/mole) | 0.145 | 0.145 | 0.145 | 0.149 | 0.149 | 0.148 |
| mass amalgam-filling ($10^{-6}$ kg) | 10 | 10 | 10 | 20 | 20 | 20 |
| % by weight of Na/% by weight of Hg | 18.4/81.6 | 18.4/81.6 | 18.4/81.6 | 18.4/81.6 | 18.4/81.6 | 18.4/81.6 |
| average temperature $\overline{T}$ of gaseous part of the filling in operative condition (K) | 2450 | 2450 | 2450 | 2700 | 2700 | 2800 |
| propagation speed c (m/s) of sound waves | 481 | 481 | 481 | 501 | 501 | 512 |
| pressure P of the filling in operative condition (Pa) | $544 \times 10^{+3}$ | $544 \times 10^{+3}$ | $544 \times 10^{+3}$ | $345 \times 10^{+3}$ | $345 \times 10^{+3}$ | $465 \times 10^{+3}$ |
| operating position | vertical | vertical | horizontal | vertical | horizontal | vertical |
| average power (W) | 70 | 70 | 70 | 150 | 150 | 250 |
| frequency $\nu_i$ (Hz) | $16.8 \times 10^{+3}$ | $26.9 \times 10^{+3}$ | $9.4 \times 10^{+3}$ | $6.9 \times 10^{+3}$ | $6.9 \times 10^3$ | $6.27 \times 10^3$ |
| modulation depth $M_{\nu i}$ | 0.425 | 0.71 | 0.11 | 0.24 | 0.22 | 0.113 |
| $2{,}35 \frac{\nu_i Le}{c}$ | 3.85 | 6.16 | 2.15 | 2.27 | 2.27 | 2.35 |
| geometric lamp factor $f_i$ | 0.50 | 0.23 | 0.72 | 0.51 | 0.51 | 0.55 |
| $M_{\nu i} \cdot f_i \cdot P \cdot d$ | 381 | 293 | 141 | 200 | 183 | 198 |
| reference numeral in FIG. 5 | 4a | 12 | 4b | 6 | 6a | 19 |

| lamp number | HF100 | HF100 | HF100 | HF102 | HF102 |
|---|---|---|---|---|---|
| mean inner diameter d discharge vessel (m) | $6.85 \times 10^{-3}$ | $6.85 \times 10^{-3}$ | $6.85 \times 10^{-3}$ | $6.85 \times 10^{-3}$ | $6.85 \times 10^{-3}$ |
| insertion depth PB (m) | $7.61 \times 10^{-3}$ | $7.61 \times 10^{-3}$ | $7.61 \times 10^{-3}$ | $7.61 \times 10^{-3}$ | $7.61 \times 10^{-3}$ |
| volume discharge vessel ($m^3$) | $3.01 \times 10^{-6}$ | $3.01 \times 10^{-6}$ | $3.01 \times 10^{-6}$ | $3.01 \times 10^{-6}$ | $3.01 \times 10^{-6}$ |
| effective length Le (m) | $8.17 \times 10^{-2}$ | $8.17 \times 10^{-2}$ | $8.17 \times 10^{-2}$ | $8.17 \times 10^{-2}$ | $8.17 \times 10^{-2}$ |
| Xe-pressure at 300 K (Pa) | $31.7 \times 10^3$ | $31.7 \times 10^3$ | $31.7 \times 10^3$ | $44.4 \times 10^3$ | $44.4 \times 10^3$ |
| mean weight per mole $\overline{M}$ of gaseous part of filling in operative condition (kg/mole) | 0.148 | 0.148 | 0.148 | 0.145 | 0.145 |
| mass amalgam-filling ($10^{-6}$ kg) | 20 | 20 | 20 | 20 | 20 |
| % by weight of Na/% by weight of Hg | 18.4/81.6 | 18.4/81.6 | 18.4/81.6 | 18.4/81.6 | 18.4/81.6 |
| average temperature | 2800 | 2800 | 2800 | 2800 | 2800 |

TABLE-continued

| | | | | | |
|---|---|---|---|---|---|
| $\overline{T}$ of gaseous part of the filling in operative condition (K) | | | | | |
| propagation speed c (m/s) of sound waves | 512 | 512 | 512 | 517 | 517 |
| pressure P of the filling in operative condition (Pa) | $465 \times 10^{+3}$ | $465 \times 10^{+3}$ | $465 \times 10^{3}$ | $610 \times 10^{+3}$ | $610 \times 10^{+3}$ |
| operating position | vertical | vertical | horizontal | horizontal | horizontal |
| average power (W) | 250 | 250 | 250 | 250 | 250 |
| frequency $\nu_i$ (Hz) | $11.1 \times 10^3$ | $16.8 \times 10^3$ | $6.27 \times 10^3$ | $6.3 \times 10^3$ | $11.3 \times 10^3$ |
| modulation depth $M_{\nu i}$ | 0.142 | 0.274 | 0.097 | 0.088 | 0.092 |
| $2{,}35 \frac{\nu_i Le}{c}$ | 4.16 | 6.3 | 2.35 | 2.34 | 4.2 |
| geometric lamp factor $f_i$ | 0.46 | 0.33 | 0.55 | 0.55 | 0.46 |
| $M_{\nu i} \cdot f_i \cdot P \cdot d$ | 208 | 288 | 170 | 202 | 177 |
| reference numeral in FIG. 5 | 19a | 19b | 19c | 20 | 20a |

FIG. 5 indicates besides the value of $M\nu_i \cdot f_i \cdot d$ as a function for the individual lamps also the relation $M\nu_i \cdot f_i \cdot P \cdot d = 185$ denoted by the reference numeral 100 and the relation $M\nu_i \cdot f_i \cdot P \cdot d = 140$ denoted by the reference numeral 101. These lines denoted by reference numerals 100 and 101 therefore limit the regions within which an interference-free operation dependent upon the operating position is guaranteed.

Figure 3:
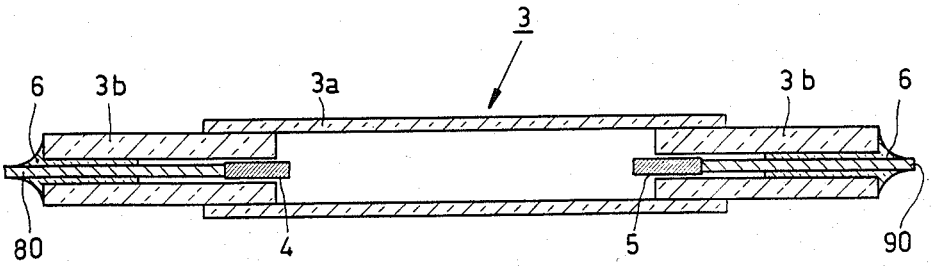

The discharge vessel 3 shown in FIG. 3, which is symmetrical with respect to a plane perpendicular to the longitudinal axis of the discharge vessel, consists of an elongate part 3*a* of circular cross-section provided on either side with sintered end parts 3*b*. The part enclosed by the part 3*a* accommodates two pin-shaped electrodes 4 and 5 between which extends the discharge track and the discharge takes place in the operative condition of the lamp. The electrode 4 is connected to a current-supply member 80 which is connected in a gas-tight manner with the aid of a sealing glass 6 to an end part 3*b*. In an analogous manner, the electrode 5 is connected to a current-supply member 90. The two end parts and the tubular part of the discharge vessel consists of a ceramic material, i.e. densely sintered polycrystalline alumina. The pin-shaped electrodes are made of tungsten and the current-supply members consist of niobium.

Each of the electrodes 4 and 5 is partly tightly surrounded by an end part 3*b*. In this configuration, the insertion depth PB assigned to each of the electrodes 4 and 5 substantially corresponds to the length of the part of each of the pin-shaped electrodes 4 and 5 which is not surrounded by end part 3*b*.

For the lamp provided with a discharge vessel according to FIG. 3, the characteristics of the discharge vessel were:

inner diameter d: $2.5 \times 10^{-3}$ m
insertion depth PB: $2.88 \times 10^{-3}$ m
volume: $7.26 \times 10^{-8}$ m$^3$
effective length Le: $1.48 \times 10^{-2}$ m
amalgam filling: 10 mg, of which 27% by weight of Na and 73% by weight of Hg.
Xe pressure at 300 K: $110 \times 10^3$ Pa
pressure P in operative condition: $910 \times 10^3$ Pa
propagation speed c of sound waves through the filling: 466 m/s.

The lamp was operated with a power of 26 W in vertical position. A first power component having a frequency $\nu_i$ of $29.5 \times 10^3$ Hz corresponding to i=2 and a modulation depth $M\nu_i$ of 0.19 resulted in a geometric lamp factor $f_i$ of 0.94 and a value for the product $M\nu_i \cdot f_i \cdot P \cdot d$ of 406.

A second power component having a frequency $\nu_i$ of $57.5 \times 10^3$ Hz corresponding to i=4 and a modulation depth $M\nu_i$ of 0.58 resulted in a geometric lamp factor $f_i$ of 0.32 and a value for the product $M\nu_i \cdot f_i \cdot P \cdot d$ of 420.

The corresponding points are denoted in the graph of FIG. 5 by reference numerals 16 and 17, respectively. The lamp just did not exhibit arc instabilities due to longitudinal acoustic resonances.

Figure 4:
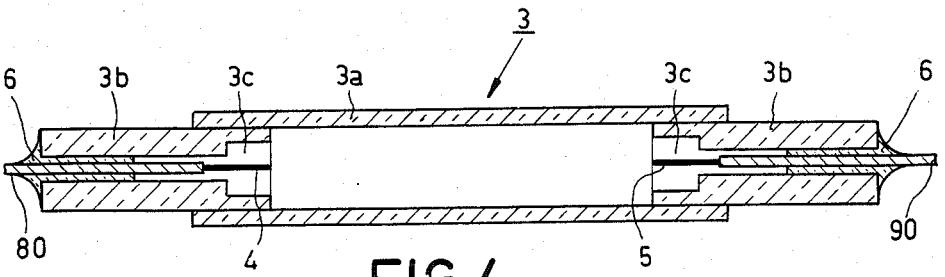

The discharge vessel shown in FIG. 4 is a modification of the discharge vessel of FIG. 3, in which corresponding parts are denoted by like reference numerals. In this modification, each of the electrodes 4 and 5 is surrounded throughout its length by an end part 3*b* of the discharge vessel 3. The end part 3*b* then partly tightly surrounds the pin-shaped electrode 4 and 5, respectively, and partly with a large amount of clearance while forming a chamber-shaped space 3*c*.

In a lamp provided with the discharge vessel according to the construction shown in FIG. 4, the inner diameter d of the elongate part 3*a* was $2.5 \times 10^{-3}$ m. The chamber-shaped spaces 3*c* each had a radius of approximately $0.7 \times 10^{-3}$ m and a depth of approximately $1.8 \times 10^{-3}$ m. Each of the pin-shaped electrodes 4 and 5 had an inner diameter of $0.2 \times 10^{-3}$ m. The insertion depth PB of each of the electrodes 4 and 5 was $0.55 \times 10^{-3}$ m. The volume of the discharge vessel amounted to $7.9 \times 10^{-8}$ m$^3$. The effective length $L_e$ was therefore $16.1 \times 10^{-3}$ m and consequently Le/d ~ 6.4, i.e. larger than 2.

The lamp described which is suitable for dissipation of a power of approximately 26 W, was operated in vertical position with a supply voltage of approximately 220 V consisting of a sinusoidally alternating voltage component and a direct voltage component. The power component varying sinusoidally with time had a frequency $\nu_i$ of 29 kHz and the modulation depth $M\nu_i$ was 0.5 .

During operation of the lamp, the overall pressure in the discharge vessel was approximately $860 \times 10^3$ Pa. The temperature in the discharge vessel had an average value of 2600 K. The filling of the discharge vessel then contained 10 mg of amalgam, of which 27% by weight of natrium and 73% by weight of mercury. Moreover, the discharge vessel contained xenon, which at 300 K had a pressure of $53.3 \times 10^3$ Pa. The speed of sound during operation of the lamp in the discharge vessel was approximately 504 m/s.

The ratio $2.35\nu_i Le/c$ corresponded to 2.17, which implies that i was =2. The associated value of $f_i$ was 0.213. The product $M\nu_i \cdot f_i \cdot P \cdot d$ was 229 and hence larger than 185. At a value of the product $M\nu_i \cdot f_i \cdot P \cdot d$ smaller than 185, any possibility of the occurrence of arc instabilities due to acoustic resonance is excluded. During operation, the lamp described operated without arc instabilities due to longitudinal acoustic resonances. In the graph of FIG. 5, the lamp is designated by reference numeral 15. The modulation depth $M\nu i$, at which just no arc instabilities due to acoustic resonance occur, was in this case 0.6. In FIG. 5, the corresponding point is designated by reference numeral 15*a*. The radiation emitted by the lamp had a general color rendition index Ra of approximately 80 at a color temperature of approximately 2500 K, which renders the lamp particularly suitable for interior illumination purposes.

It should be noted that the pressure of the filling of the discharge vessel of the lamp in the operative condition, that is to say the sum of the Na-pressure, the Hg-pressure and the Xe-pressure, in the embodiments described in the present application is determined by means of methods described in an article of van Vliet and de Groot entitled "High-pressure sodium discharge lanmps", published in I.E.E.E. Proc., Vol. 128, Pt. A. no. 6, September 1981, p. 415–441. For the rare gas pressure, this is approximately 8 times the pressure at room temperature (300 K) (p. 425, section 5.3); for the Na-pressure $P_{Na}$, use is made of the so-called line widening $\Delta\lambda_B$ as descried on page 426, left hand column, lines 3–7, and of the formula $$\Delta\lambda_B = (1/2.2)P_{Na}\sqrt{d/0.76}\ .$$

For the Hg-pressure, use is made of the amalgam composition and the experimental results as stated on page 426, FIG. 28.

What is claimed is:

1. A high-pressure sodium discharge lamp provided with an elongate discharge vessel which encloses a discharge vessel which encloses a discharge path and which vessel has an effective length $L_e$ and, over at least $\frac{2}{3}$ of the discharge path a cross-section S of constant area, in which vessel two electrodes are arranged each having an end, between which ends the discharge path extends, said lamp being operative with a power of periodically alternating value, this power comprising one or more power components sinusoidally varying with time and at least one component having a frequency $\nu_i$ for which it holds that $i-0.45 \leqq 2.35\nu_i Le/c \leqq i+0.45$, where i is an integral positive number and c is the average speed in m/s of propagation of sound waves through the gaseous part of the filling of the discharge vessel in the operative condition of the lamp, characterized in that the filling in the operative condition has a pressure P of at least $170\times10^3$ Pa and in that for each value of i the relation $M\nu_i \cdot f_i \cdot P \cdot d \leqq 185$ is satisfied, in which $M\nu_i$ is the modulation depth of the power component frequency $\nu_i$, $f_i$ is a geometric lamp factor and d is the mean inner diameter of the cross-section S in meters.

2. A lamp as claimed in claim 1, in which the discharge vessel is substantially symmetrical with respect to a plane at right angles to the longitudinal axis of the discharge vessel, characterized in that the same insertion depth PB is associated with each electrode and in that in the operative condition of the lamp, for each even value of i the relation is satisfied:

$$M\nu_i \cdot 2/i\,|\sin i\,\pi PB/Le| \cdot P \cdot d \leqq 185.$$

3. A lamp as claimed in claim 1, characterized in that in the operative condition of the lamp the relation is satisfied: $M\nu_i \cdot f_i \cdot P \cdot d \leqq 140$.

4. A lamp as claimed in claim 1, characterized in that the operating power of the lamp is composed of one or more current and voltage components sinusoidally varying with time, the frequencies of which all amount to at least 20 kHz.

5. A lamp as claimed in claim 1, the consumed power of which in the operative condition is at most 100 W, characterized in that in the operative condition of the lamp the pressure in the discharge vessel is at least $300\times10^3$ Pa and at most $1600\times10^3$ Pa.

6. A lamp as claimed in claim 2, characterized in that the operating power of the lamp is composed of one or more current and voltage components sinusiodally varying with time, the frequencies of which all amount to at least 20 kHz.

7. A lamp as claimed in claim 3, characterized in that the operating power of the lamp is composed of one or more current and voltage components sinusoidally varing with time, the frequencies of which all amount to at least 20 kHz.

8. A lamp as claimed in claim 2, the consumed power of which in the operative condition is at most 100 W, characterized in that in the operative condition of the lamp the pressure in the discharge vessel is at least $100\times10^3$ Pa and at most $1600\times10^3$ Pa.

9. A lamp as claimed in claim 3, the consumed power of which in the operative condition is at most 100 W, characterized in that in the operative condition of the lamp the pressure in the discharge vessel is at least $300\times10^3$ Pa and at most $1600\times10^3$ Pa.

10. A lamp as claimed in claim 4, the consumed power of which in the operative condition is at most 100 W, characterized in that in the operative condition of the lamp the pressure in the discharge vessel is at least $300\times10^3$ Pa and at most $1600\times10^3$ Pa.

* * * * *

UNITED STATES PATENT AND TRADEMARK OFFICE

CERTIFICATE OF CORRECTION

PATENT NO. : 4,527,097

DATED : July 2, 1985

INVENTOR(S) : RUDOLF L.A. VAN DER HEIJDEN ET AL

It is certified that error appears in the above-identified patent and that said Letters Patent is hereby corrected as shown below:

IN THE CLAIMS:

Claim 8, line 5, change "$100x10^3$" to --$300x10^3$--

Signed and Sealed this

Third Day of November, 1987

*Attest:*

DONALD J. QUIGG

*Attesting Officer*

*Commissioner of Patents and Trademarks*